United States Patent [19]

Peroni

[11] Patent Number: 4,514,877

[45] Date of Patent: May 7, 1985

[54] STOVE DAMPER HANDLE

[75] Inventor: Peter A. Peroni, Pottstown, Pa.

[73] Assignee: LaFrance Corporation, Philadelphia, Pa.

[21] Appl. No.: 468,088

[22] Filed: Feb. 22, 1983

[51] Int. Cl.[3] ..... G05G 2/10

[52] U.S. Cl. ..... 16/111 R; 16/121; 16/DIG. 24; 16/DIG. 30; 403/4

[58] Field of Search ..... 16/110 R, 111 R, 111 A, 16/116 R, 112, 115, 118, 121, DIG. 5, DIG. 12, DIG. 18, DIG. 19, DIG. 30, DIG. 24, 40–42; 126/285 A, 289, 290; 74/553, 548–551, 543–545; D8/307, 310; 403/3, 4; 248/188.9, 188.8, 188, 148, 536

[56] References Cited

U.S. PATENT DOCUMENTS

| | | | |
|---|---|---|---|
| 60,412 | 12/1866 | Oppenheimer | 126/290 |
| 134,372 | 12/1872 | Frank | 126/290 |
| 157,468 | 12/1874 | Adams et al. | 126/290 |
| 574,399 | 1/1897 | Dawes | 16/121 |
| 1,951,188 | 3/1934 | Flaherty | 16/DIG. 30 X |

*Primary Examiner*—James M. Meister
*Assistant Examiner*—John L. Knoble
*Attorney, Agent, or Firm*—Connolly and Hutz

[57] ABSTRACT

A handle for a stove damper or the like includes an elongated rod mounted in a boss secured to the handle member. The handle member is disposed at an angle to the rod. The rod is mounted in the boss in such a manner that axial, rotational and pivotal movement is prevented.

7 Claims, 9 Drawing Figures

STOVE DAMPER HANDLE

BACKGROUND OF THE INVENTION

The present invention is directed to a novel handle, particularly one secured to a stove damper in such a manner that movement of the handle results in corresponding movement of the stove damper. In this manner the damper may be conveniently selectively moved to its opened and closed positions. Generally such handles include rods having a plate-like handle member secured at one end thereof with the opposite end secured to the stove damper. In the prior art such plates are usually perpendicular to the rod.

SUMMARY OF THE INVENTION

An object of this invention is to provide a handle particularly suitable for actuating a stove damper wherein the handle member is at an angle other than 90° to the rod axis.

A further object of this invention is to provide such a handle which can be conveniently manufactured at relatively low cost.

In accordance with this invention, the handle comprises an elongated rod which is preferably of circular cross section mounted to a preferably plate-like handle member by means of a boss secured to the handle member. The rod is telescopically received in the boss and is secured to the boss in such a manner that axial and rotatable and pivotal movement of the rod is prevented.

In the preferred form of this invention the boss is generally U-shaped in cross section having an open side area dimensioned to permit the rod to be inserted through the open side area. The boss has a grooved floor for receiving the edge of one end of the rod while the rod contacts opposed edges on an open face of the boss. The result of this arrangement is that the rod makes contact with the boss at a plurality of points which, in addition to securing the rod to the boss by means of pins, assures that the rod cannot slide, turn or pivot.

THE DRAWINGS

DETAILED DESCRIPTION

Figure 2:
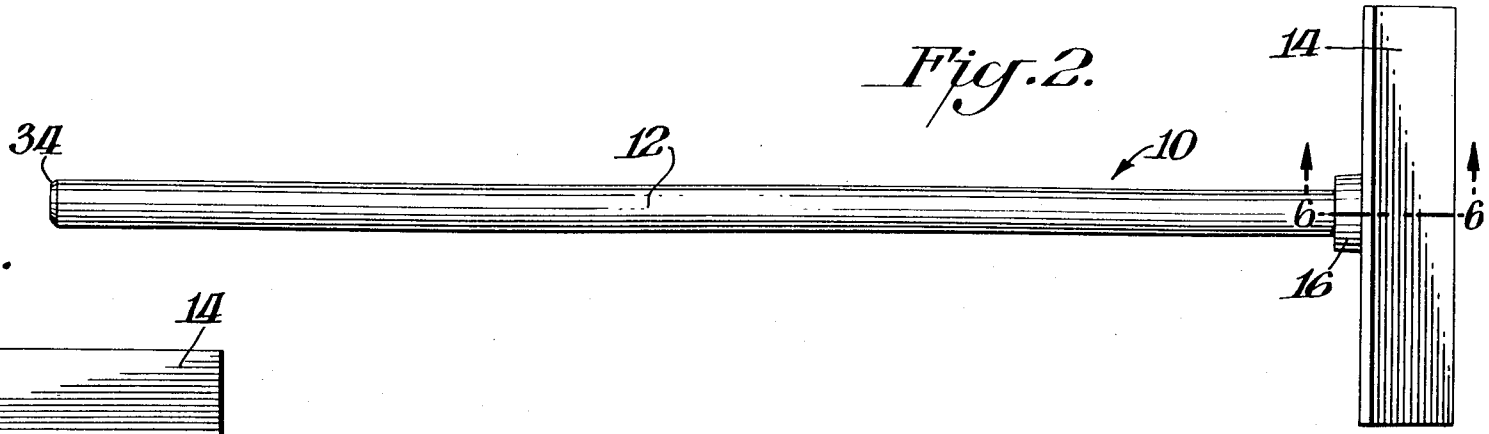
FIGS. 2 and 3 are top and bottom plan views of the handle shown in FIG. 1.

FIGS. 1–8 illustrate to scale a handle 10 in accordance with this invention. As indicated therein, the handle includes an elongated rod 12 which is preferably of circular cross section. Handle 10 also includes a handle member 14 in the form of a plate secured to rod 12 at an angle other than 90° to the longitudinal axis of rod 12. Rod 12 and handle member 14 are secured together by means of a boss 16 integral with handle member 14. Rod 12 is secured in such a manner that axial rotational and pivotal movement thereof with respect to handle member 14 is effectively prevented.

As illustrated in the drawings, boss 16 is hollow and has an open face remote from handle member 14. Boss 16 also includes an open side area 20 which is dimensioned so that the open area is at least as wide as the diameter of rod 12. Thus rod 12 may be easily telescoped into boss 16 by means of the open face 18 and/or open side area 20.

Figure 1:
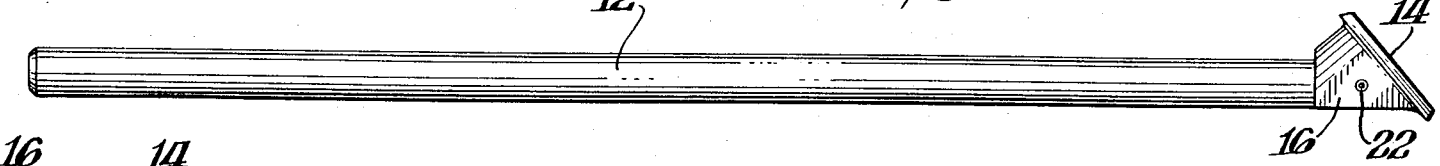
FIG. 1 is a side elevation view of a handle in accordance with this invention.
Figure 3:
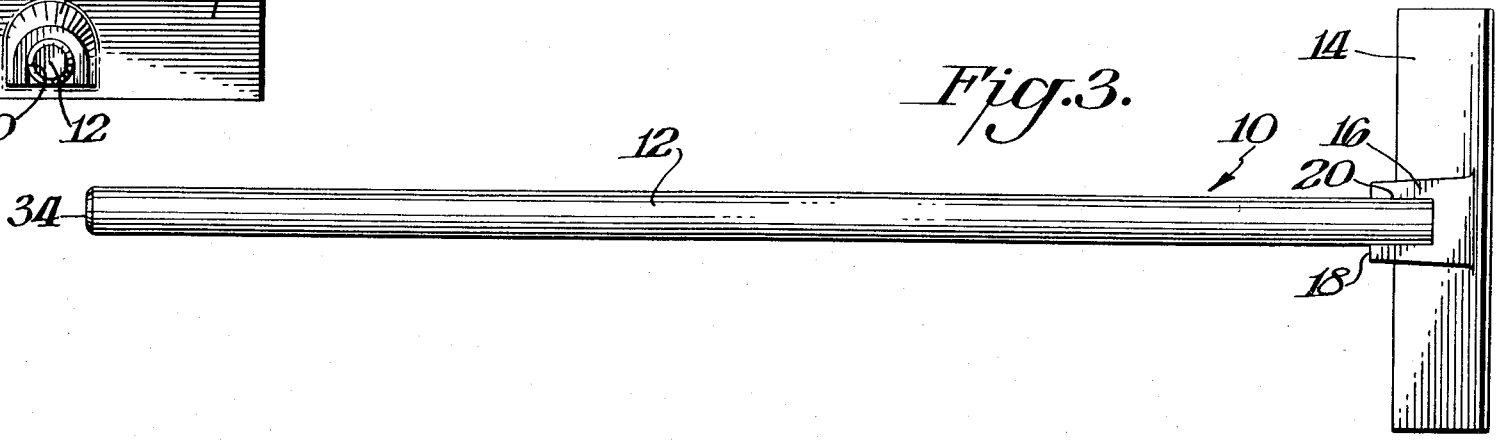
Figure 4:
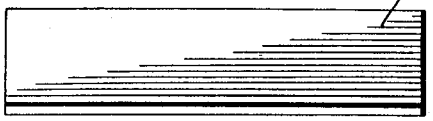
FIGS. 4 and 5 are front and rear elevation views of the handle shown in FIGS. 1–3.
Figure 5:
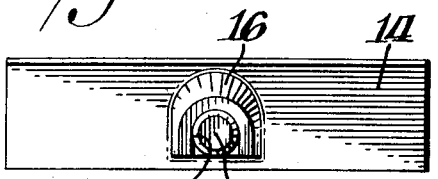
Figure 6:
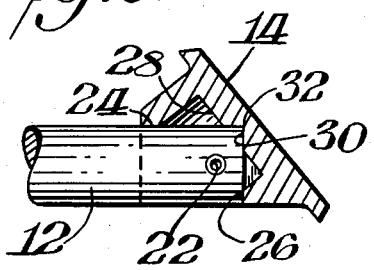
FIG. 6 is a cross-sectional view taken through FIG. 2 along the line 6—6.
Figure 8:
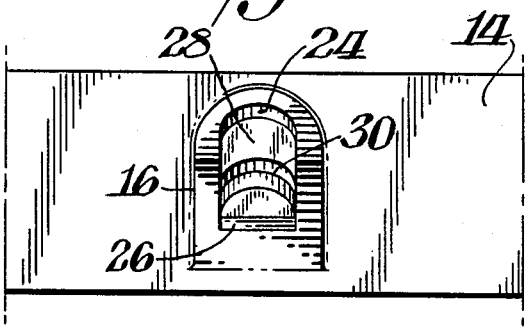
FIG. 8 is a front elevation view of the handle member and boss shown in FIG. 7.
Figure 7:
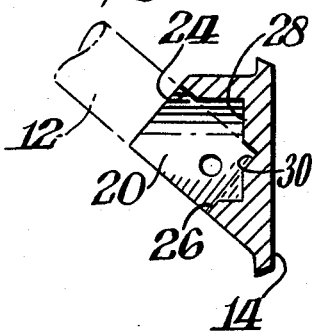
FIG. 7 is a cross-sectional view showing a portion of the handle member and boss with the rod shown in phantom.

As shown in FIGS. 1 and 6, rod 12 is secured to flat opposite wall portions of boss 16 by means of pins 22. Each pin 22 extends through a corresponding wall portion of boss 16 and into rod 12. In the illustrated form a pair of aligned pins 22 are utilized. Other arrangements, however, such as a single pin extending completely through boss 16 and rod 12 may also be used; or a single pin may extend through one side of boss 16 and into rod 12.

The provision of the pin means 22 to secure rod 12 to boss 16 results in preventing rod 12 from moving axially or rotationally about its own axis. Boss 16, however, also prevents pivotal movement about pins 22. This is accomplished by the provision of a number of edges of boss 16 for contacting rod 12. Specifically, the edges include a pair of oppositely disposed edges 24, 26 at the open face 18 of boss 16. Additionally the floor 28 of box 16 is provided with an arcuate groove 30 which is dimensioned to conform to the pointed edge 32 of rod 12. As shown, for example, in FIG. 6, rod 12 thus makes three point contact with boss 16 at edges 24 and 26 as well as groove 30. This three point contact effect prevents any tendency for rod 12 to pivot about pins 22. Thus, once assembled, rod 12 is locked in place against any relative movement with respect to handle member 14.

One of the features of this invention is the angular disposition of handle member 14 with respect to rod 12. In this respect, the angular orientation is such that a more natural grasping position would result for the user when manipulating handle 10. In the illustrated form of the invention, plate or handle member 14 is at an angle of 50° with respect to the longitudinal axis of rod 12. Similarly floor 28 would also be at the same angle of 50° with respect to the rod longitudinal axis. The open side area 20 of boss 16, however, is planar and parallel to the longitudinal axis of rod 12. In a preferred form of this invention, boss 16 is integral with handle member 14, the members being, for example, die cast from any suitable material such as zinc or aluminum or molded plastic (heat resistant). As shown in the drawings, boss 16 is of generally U-shaped cross section wherein the open face of the U is the planar side 20. Box 16 then includes a pair of parallel planar wall sections through which pins 22 extend with the parallel wall sections then blending into an arcuate wall remote from wall section 20.

The components of handle may be of any suitable dimensions. For example, the plate-like handle member 14 may be 3.9 inches by 1.46 inches. Rod 12 may be about 13.75 inches long with a diameter of 0.5 inches. Preferably the remote end 34 of rod 12 is bevelled to facilitate insertion or the securement to the stove damper or the like.

The maximum spacing between opposed walls of boss 16 would be at least 0.5 inches and preferably 0.508 inches.

Figure 9:
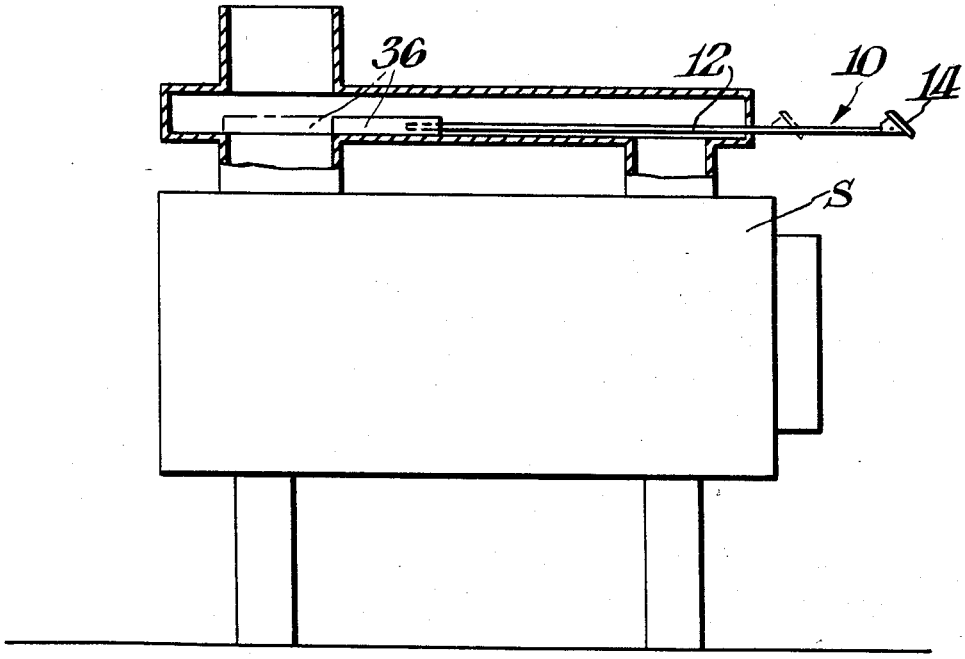
FIG. 9 is an elevation view partly in section illustrating the handle of FIGS. 1–8 for use with a stove damper.

FIG. 9 shows a preferred use of handle 10 wherein the remote end 34 is secured to a damper 36 of a stove S. As shown in FIG. 9, the damper is illustrated in the open position in solid lines and in the closed position in dotted lines. It is to be understood that while the preferred use of handle 10 is with a stove damper, the concepts of this invention may be practiced in other environments wherein there is a need for a handle to actuate a member from one position to another. For example, handle 10 may also be used for actuating movable members in a motorized van.

As can be appreciated, handle 10 may be easily assembled with minimal parts at relatively low cost and without sacrifice to the effectiveness thereof. In addition, the particular arrangement of the components of handle 10 is such so as to maximize the convenience of use by the user.

What is claimed is:

1. A handle for a stove damper comprising an elongated rod having a remote end and a near end, said remote end being adapted to be secured to the damper whereby movement of said rod causes corresponding movement of the damper, a handle member for being grasped by the user, mounting means securing said handle member to said near end of said rod at a non-perpendicular angle thereto, said mounting means comprising a hollow boss secured to said handle member, said boss having an open face remote from said handle member telescopically receiving said rod therein, means securing said rod to said boss preventing axial and rotational movement of said rod with respect to said boss, said boss having edge means in contact with said remote end of said rod preventing any pivotal movement of said rod with respect to said boss, said boss being of generally U-shaped cross section having an elongated open side area of a dimension at least as great as the width of said rod to permit said rod to be inserted into said boss through said open side area, and said open side area remaining open and exposed after insertion of said rod.

2. The handle of claim 1 wherein said rod is of circular cross section, said boss having a floor, a groove in said floor, an edge of said rod member positioned in said groove, opposed edges of said open face contacting said rod, and said groove and said opposed edges comprising said edge means.

3. The handle of claim 2 wherein said handle member is in the form of a plate, said boss being integral with said plate, said open face of said boss being perpendicular to the longitudinal axis of said rod, said groove being arcuate shaped conforming to the curvature of said edge of said rod member, and said means preventing axial and rotational movement of said rod being pin means extending through said boss and into said rod.

4. The handle of claim 3 wherein said open side area of said boss is generally planar and parallel to said longitudinal axis of said rod, said planar open said area merging into a pair of parallel side wall portions, said side wall portions merging into a curved portion remote from said open side area and conforming to the curvature of said rod, said pin means extending through said side wall portions, said floor being parallel to said plate, and said side wall portions extending perpendicularly away from said plate.

5. The handle of claim 4 wherein said plate is at an angle of about fifty degrees with respect to said longitudinal axis of said rod, and said pin means comprising a pin extending through each of said side wall portions.

6. The handle of claim 5, in combination therewith, a stove having a damper, and said rod being secured to said damper.

7. The handle of claim 1, in combination therewith, a stove having a damper, and said rod being secured to said damper.

* * * * *